US007899381B2

(12) United States Patent
Chiba et al.

(10) Patent No.: US 7,899,381 B2
(45) Date of Patent: Mar. 1, 2011

(54) IMAGE FORMATION APPARATUS AND IMAGE FORMATION METHOD

(75) Inventors: Satoshi Chiba, Suwa (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/573,702

(22) Filed: Oct. 5, 2009

(65) Prior Publication Data

US 2010/0092222 A1 Apr. 15, 2010

(30) Foreign Application Priority Data

Oct. 14, 2008 (JP) ..... 2008-264873

(51) Int. Cl.
*G03G 21/00* (2006.01)

(52) U.S. Cl. ..... 399/345; 399/121; 399/308; 399/351

(58) Field of Classification Search ..... 399/66, 399/71, 121, 123, 297, 302, 308, 313, 345, 399/348, 350, 351
See application file for complete search history.

(56) References Cited

U.S. PATENT DOCUMENTS 6,335,098 B1 * 1/2002 Kutzner et al. ..... 428/422
6,449,453 B1 * 9/2002 Motohashi ..... 399/302
2002/0034405 A1 * 3/2002 Kayahara et al. ..... 399/297

FOREIGN PATENT DOCUMENTS

JP 2001-166611 6/2001

* cited by examiner

*Primary Examiner*—David P Porta
*Assistant Examiner*—Benjamin Schmitt
(74) *Attorney, Agent, or Firm*—DLA Piper LLP (US)

(57) ABSTRACT

An image formation apparatus includes a roller member that contacts a developer retaining member at a position and is distanced from the developer retaining member at another position. A contact edge of a cleaning blade supported by a supporting member is in contact with the roller member. A first plane of the cleaning blade that is supported by the supporting member, or is opposite to a surface that is supported by the supporting member, and a second plane of the cleaning blade form the contact edge. An angle $\theta_1$ formed by a virtual vertical plane and the second plane thereunder when the roller member is distanced from the developer retaining member is greater than zero degrees but not greater than ninety degrees.

6 Claims, 13 Drawing Sheets

IMAGE FORMATION APPARATUS AND IMAGE FORMATION METHOD

BACKGROUND

1. Technical Field

The present invention generally relates to an image formation apparatus and an image formation method. In particular, the invention can be suitably applied to an image formation apparatus that uses a liquid developer containing toner particles and carrier liquid.

2. Related Art

As an example of an image formation apparatus that uses a liquid developer, an apparatus that is provided with the following components is disclosed in JP-A-2001-166611; the components include a latent image carrier (e.g., photosensitive drum) on which a latent image is formed, a developing section (e.g., developing device) that develops the latent image with the use of a liquid developer to form a developed image on the latent image carrier, a primary image transfer member that transfers the developed image formed on the latent image carrier onto the image-carrying surface of a transfer member (e.g., intermediary image transfer belt) that moves cyclically for primary image transfer, and a secondary image transfer roller that can be brought into contact with the image-carrying surface of the transfer member with a recording target medium being pinched therebetween to further transfer the image transferred to the image-carrying surface onto the recording target medium for secondary image transfer (refer to FIG. 1). Such an image formation apparatus of related art has a plurality of members each of which has a surface for retaining a liquid developer and moves cyclically. Examples of these members are the latent image carriers, primary image transfer rollers, the secondary image transfer roller, and the like. These members may be hereinafter referred to as "retaining members". A contact edge of a cleaning blade is placed in contact with the retaining surface of a retaining member. The cleaning blade wipes a liquid developer that remains on the retaining surface off for removing the liquid developer from the retaining surface.

Some retaining members can be brought into contact with the retaining surface of another retaining member or distanced from the retaining surface thereof. For example, during the operation of an image formation apparatus, a secondary image transfer roller is set at a contact position where the outer circumferential surface of the secondary image transfer roller, which is the retaining surface of the secondary image transfer roller, is in contact with the image-carrying surface of an intermediary image transfer belt (transfer member), which is the retaining surface of the intermediary image transfer belt. On the other hand, for example, when the operation of an image formation apparatus is suspended for a while, the outer circumferential surface of the secondary image transfer roller is distanced from the image-carrying surface of the intermediary image transfer belt. The retaining member of the related art, for example, the secondary image transfer roller, has the following problems.

A cleaning blade that is urged toward and in contact with a secondary image transfer roller for cleaning the secondary image transfer roller has an end face (which may be hereinafter referred to as a "contact-side end face") and a surface that faces toward the secondary image transfer roller. An edge is formed at a region where the contact-side end face and the surface facing toward the secondary image transfer roller meet with each other. When the secondary image transfer roller is continuously distanced from an intermediary image transfer belt (transfer member) for a while, a liquid developer that gathers at a space between the outer circumferential surface of the secondary image transfer roller and the contact-side end face, which may be hereinafter referred to as a "reservoir space" or "reservoir", could drip from the reservoir space to stain inner components of the image formation apparatus.

As another problem, when an image formation apparatus is driven with a secondary image transfer roller being in contact with an intermediary image transfer belt when a sufficient amount of a liquid container is not present in a reservoir space after the setting of the secondary image transfer roller at a non-contact position where the secondary image transfer roller is distanced from the intermediary image transfer belt for a while, friction may arise between a cleaning blade and the secondary image transfer roller. The friction might cause the squeaking of the cleaning blade. Furthermore, when friction arises between the cleaning blade and the secondary image transfer roller, a driving torque of the secondary image transfer roller increases, which might result in unstable driving operation.

SUMMARY

An advantage of some aspects of the invention is to provide a technique for making it easier for a liquid developer to be securely trapped in a reservoir that is formed between a roller member (transfer roller), which is an cleaning target object that is to be cleaned, and a cleaning blade when the roller member is distanced from a roller-processing target member.

In order to address the above-identified problems without any limitation thereto, an image formation apparatus according to a first aspect of the invention includes: a developer retaining member that retains a liquid developer that contains toner particles and carrier liquid; a roller member that can be brought into contact with the developer retaining member at a position and distanced from the developer retaining member at another position; a cleaning blade that has a contact edge that is in contact with the roller member for cleaning the roller member; and a supporting member that supports the cleaning blade, wherein the cleaning blade has a first plane that is supported by the supporting member or is opposite to a surface that is supported by the supporting member and further has a second plane, the first plane and the second plane forming the contact edge, and an angle $\theta_1$ that is formed by a virtual vertical plane and the second plane thereunder when the roller member is distanced from the developer retaining member is greater than zero degree but not greater than ninety degree ($0° < \theta_1 \leqq 90°$). Examples of the "roller member" according to an aspect of the invention are a squeeze roller, a cleaning roller, a secondary image transfer roller, and the like.

In the configuration of an image formation apparatus according to the first aspect of the invention, it is preferable that an angle $\theta_2$ that is formed by a virtual vertical plane and the second plane thereunder when the roller member is in contact with the developer retaining member should be greater than the angle $\theta_1$ ($\theta_2 > \theta_1$). In the preferred configuration of an image formation apparatus described above, the angle $\theta_2$ may be greater than ninety degree ($\theta_2 > 90°$). In the configuration of an image formation apparatus according to the first aspect of the invention, the cleaning blade may be made of an oleophilic material.

An image formation apparatus according to a second aspect of the invention includes: a latent image carrier on which a latent image is formed; a developing section that develops the latent image with the use of a liquid developer that contains toner particles and carrier liquid; a transfer member onto which the image developed by the developing section on the latent image carrier is transferred; a transfer roller that can be brought into contact with the transfer member at a position and distanced from the transfer member at another position; a transfer roller cleaning blade that has a contact edge that is in contact with the transfer roller for cleaning the transfer roller; and a supporting member that supports the transfer roller cleaning blade, wherein the transfer roller cleaning blade has a first plane that is supported by the supporting member or is opposite to a surface that is supported by the supporting member and further has a second plane, the first plane and the second plane forming the contact edge, and an angle $\theta_1$ that is formed by a virtual vertical plane and the second plane thereunder when the transfer roller is distanced from the transfer member is greater than zero degree but not greater than ninety degree ($0° < \theta_1 \leqq 90°$).

In the configuration of an image formation apparatus according to the second aspect of the invention, it is preferable that an angle $\theta_2$ that is formed by a virtual vertical plane and the second plane thereunder when the transfer roller is in contact with the transfer member should be greater than the angle $\theta_1$ ($\theta_2 > \theta_1$). In the configuration of an image formation apparatus according to the second aspect of the invention, it is preferable that the same supporting unit should support the transfer roller and the transfer roller cleaning blade; and the transfer roller should be brought into contact with the transfer member or distanced from the transfer member as a result of movement of the supporting unit on a swing fulcrum.

An image formation method according to a third aspect of the invention includes: developing a latent image formed on a latent image carrier with the use of a liquid developer that contains toner particles and carrier liquid to form a developed image on the latent image carrier; transferring the developed image onto a transfer member for primary transfer; bringing a transfer roller into contact with the transfer member so that the image transferred to the transfer member further transfers onto a recording target medium for secondary transfer; and cleaning the transfer roller set at a distance from the transfer member, a contact edge of a transfer roller cleaning blade being in contact with the transfer roller for cleaning the transfer roller, the contact edge being formed by a first plane and a second plane, the first plane being supported by a supporting member that supports the transfer roller cleaning blade or is opposite to a surface that is supported by the supporting member, wherein, during the cleaning, an angle $\theta_1$ that is formed by a virtual vertical plane and the second plane of the transfer roller cleaning blade with the transfer roller being distanced from the transfer member is greater than zero degree but not greater than ninety degree ($0° < \theta_1 \leqq 90°$).

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, exemplary embodiments of the present invention will now be explained.

A. First Embodiment

Figure 1:
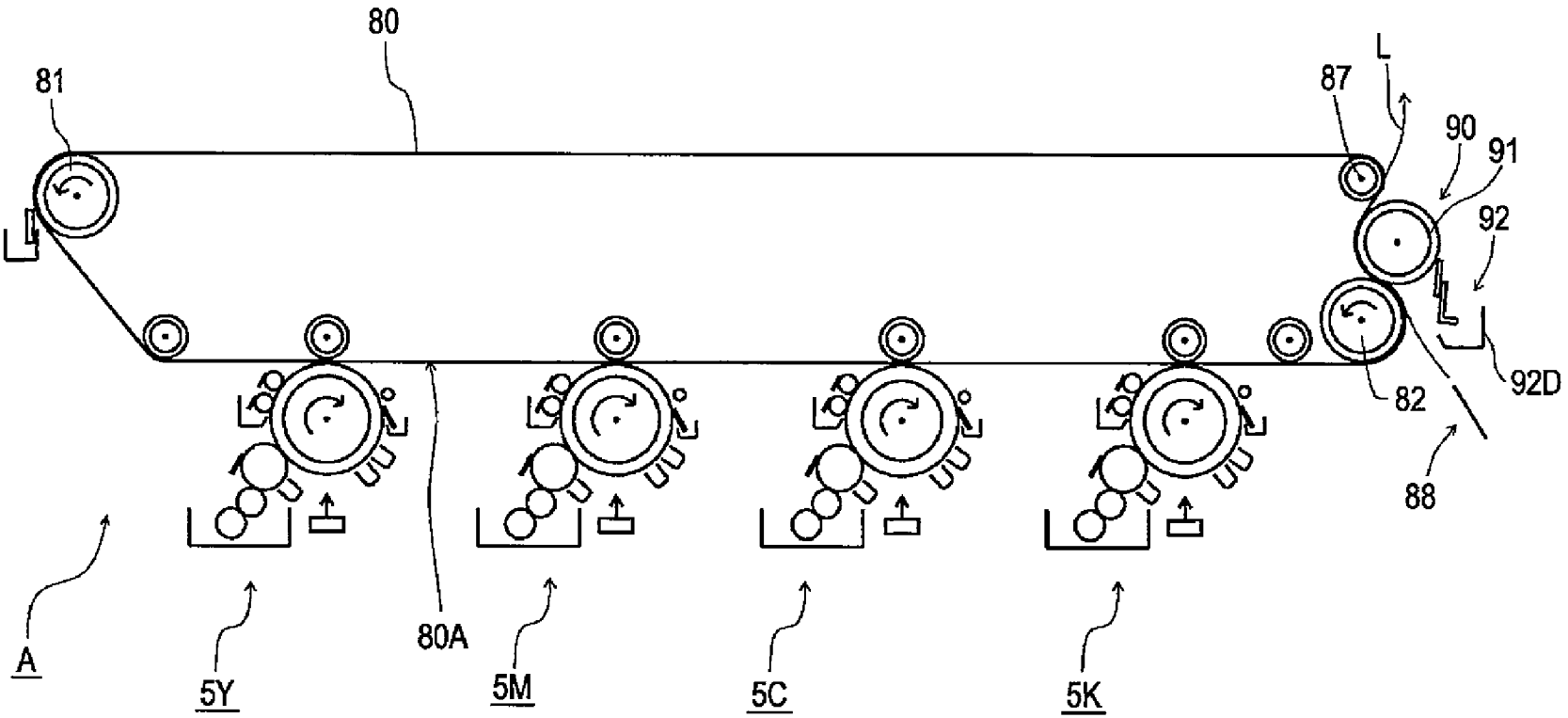
FIG. 1 is a diagram that schematically illustrates an example of main components of an image formation apparatus according to an exemplary embodiment of the invention.

The basic configuration of an image formation apparatus A according to a first embodiment of the invention is briefly explained below while referring to FIGS. 1 and 2. As illustrated in FIG. 1, the image formation apparatus A is provided with four image formation units 5Y, 5M, 5C, and 5K, an intermediary image transfer belt 80, a first roller 81, a second roller 82, an auxiliary roller 87, and a secondary image transfer unit 90. The image formation units 5Y, 5M, 5C, and 5K correspond to yellow (Y), magenta (M), cyan (C), and black (K). The image formation units 5Y, 5M, 5C, and 5K are arrayed in a horizontal direction between the first roller 81 and the second roller 82 in the order of appearance herein.

Figure 2:
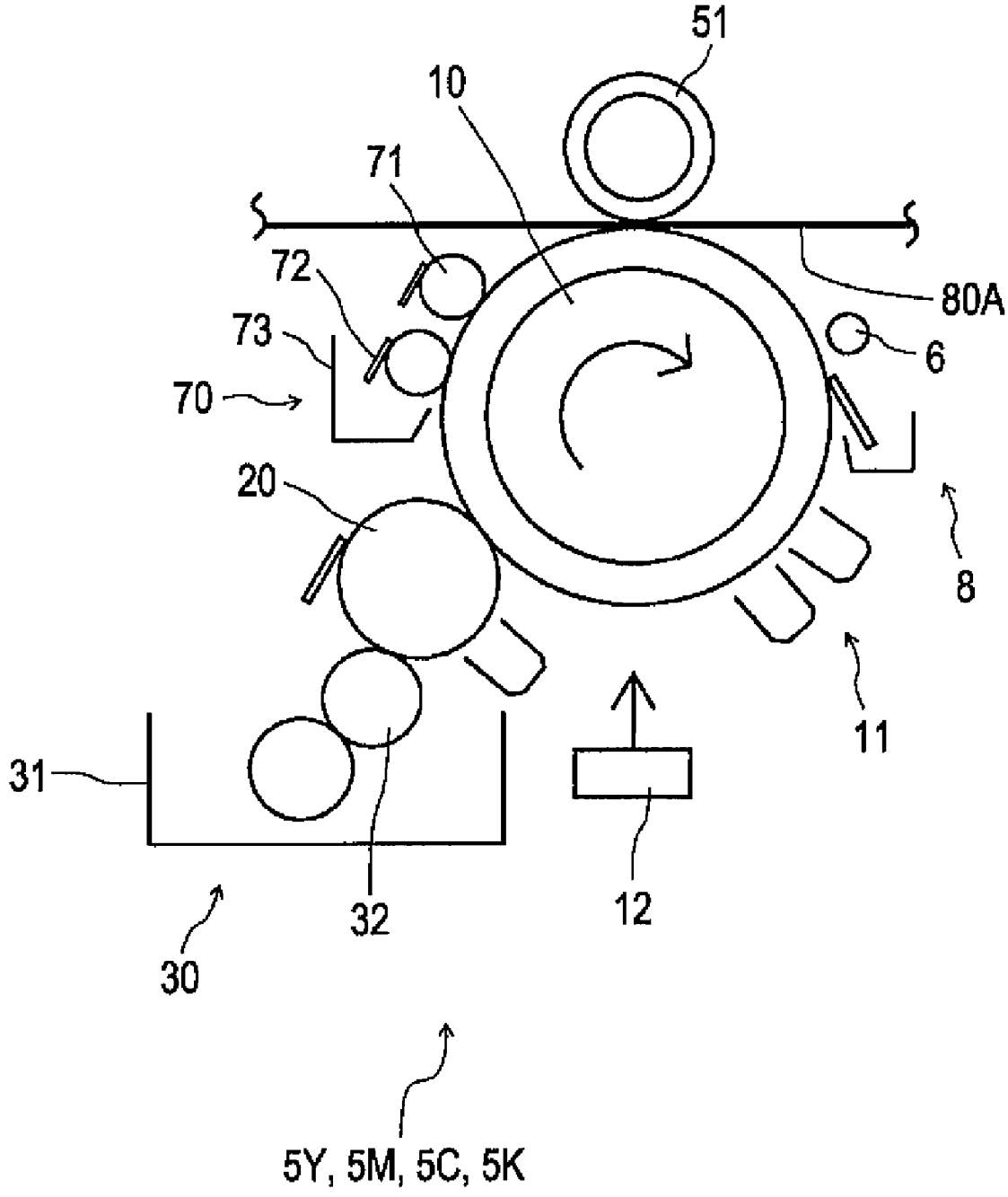
FIG. 2 is an enlarged view that schematically illustrates an example of a part of FIG. 1.

As illustrated in FIG. 2, each of the image formation units 5Y, 5M, 5C, and 5K is provided with a photosensitive drum 10, an electrification member 11, a light exposure unit 12, a developing unit 30, a photosensitive drum squeeze device 70, a primary image transfer roller 51, a diselectrification device 6, and a cleaning device 8. Each photosensitive drum 10 has a substantially cylindrical shape with a photosensitive layer formed on the outer circumferential surface thereof. The photosensitive drums have the same outer diameter of, for example, 80 mm. The electrification member 11, the light exposure unit 12, the developing unit 30, the photosensitive drum squeeze device 70, the primary image transfer roller 51, the diselectrification device 6, and the cleaning device 8 are provided around the outer circumferential surface of each photosensitive drum 10. These components are arrayed in the order of appearance herein along the direction of rotation of the photosensitive drum 10. The photosensitive layer of the photosensitive drum 10 is made of an amorphous silicon image carrier.

Each electrification member 11 is, for example, a corona electrostatic charging unit. A power supply that is not illustrated in the drawing applies a bias having a polarity that is the same as the electrification polarity of a liquid developer to the electrification member 11. Each electrification member 11 electrifies the corresponding one of the photosensitive drums 10. Notwithstanding the foregoing, each electrification member 11 may be an electrostatic charging roller. Each light exposure unit 12 emits a beam of light from an LED head, a laser-scan optical system, or the like to the corresponding photosensitive drum 10 to form a latent image thereon.

Each developing unit 30 is provided with a developing roller 20, a developer container 31, and a developer supply roller 32. A liquid developer of the corresponding color (Y, M, C, or K) is contained in the developer container 31. The developer supply roller 32 supplies a liquid developer from the developer container 31 to the developing roller 20. The developing unit 30 develops a latent image formed on the photosensitive drum 10. In the present embodiment of the invention, a liquid developer that contains toner particles and carrier liquid (nonvolatile liquid carrier) is used as a developer contained in each developer container 31.

Specifically, a liquid developer according to the present embodiment of the invention is not a "low-concentration (approx. 1 to 2 wt %) and low-viscosity volatile liquid developer that has volatility at room temperature and contains Isopar (which is a trademark of Exxon Mobil Corporation) as carrier liquid" but a "high-concentration and high-viscosity nonvolatile liquid developer having non-volatility at room temperature". More specifically, a liquid developer according to the present embodiment of the invention has a high viscosity of approximately 30 to 10000 mPa·S with a toner solid content density of approximately 25%, which can be prepared by adding a solid that has an average particle size of 1 μm and contains a coloring agent such as pigment or the like dispersed in a thermoplastic resin to a liquid solvent such as an organic solvent, silicon oil, mineral oil, edible oil or the like together with a dispersant.

The photosensitive drum squeeze device 70 is provided at a relatively downstream side viewed from the developing unit 30 along the direction of rotation of the photosensitive drum 10. The photosensitive drum squeeze device 70 recovers a developer that remains on the photosensitive drum 10. The photosensitive drum squeeze device 70 is provided with a pair of photosensitive drum squeeze rollers 71, a pair of cleaning blades 72, and a recovery container 73. The cleaning blade 72 is provided for each photosensitive drum squeeze roller 71.

The photosensitive drum squeeze roller 71, which has a diameter of 20 mm, has a metal base portion and a substantially cylindrical elastic portion. The elastic portion (e.g., urethane rubber) is attached to the outer circumferential part of the base portion. The thickness of the elastic portion is 2.5 mm. The hardness of the elastic portion conforms to JIS-30°. The volume resistivity of the elastic portion when a voltage of 250V is applied thereto is $10^6$ Ωcm. The photosensitive drum squeeze roller 71 rotates in a direction that is opposite to the direction of rotation of the photosensitive drum 10 while being in contact with the photosensitive drum 10. The photosensitive drum squeeze roller 71 removes carrier liquid that remains on the photosensitive drum 10. Each of the cleaning blades 72 is made of an elastic member such as a rubber or the like. Each cleaning blade 72 is in contact with the corresponding photosensitive drum squeeze roller 71. Urging pressure is applied to the cleaning blade 72 toward the photosensitive drum squeeze roller 71. The cleaning blade 72 wipes (e.g., scrapes) carrier liquid that remains on the photosensitive drum squeeze roller 71 off for removal. The recovery container 73, which is a recovery member, is used for catching a liquid developer wiped off by each cleaning blade 72.

The first roller 81 and the second roller 82 are provided with a predetermined horizontal distance therebetween. The intermediary image transfer belt 80 is an endless belt that is stretched between the first roller 81 and the second roller 82. The intermediary image transfer belt 80 turns cyclically between the first roller 81 and the second roller 82 while being driven by the second roller 82, which is a driving roller. In the operation of the image formation apparatus A according to the present embodiment of the invention, a regional part of the intermediary image transfer belt 80 that is curved along and in contact with the second roller 82 travels along the auxiliary roller 87, which is provided over the second roller 82, and thereafter travels toward the first roller 81. The first roller 81 is a tension roller that applies an appropriate tension to the intermediary image transfer belt 80.

The intermediary image transfer belt 80 is made of conductive polyimide. The width of the intermediary image transfer belt 80 is 324 mm. The thickness of the intermediary image transfer belt 80 is 0.08 mm. The volume resistivity of the intermediary image transfer belt 80 when a voltage of 250V is applied thereto is $10^{10}$ Ωcm. The surface resistivity of the intermediary image transfer belt 80 is $10^{11}$ Ω/sq. The outer surface of the intermediary image transfer belt 80 constitutes an image-carrying surface (and a retaining surface) 80A. As a modification example of the intermediary image transfer belt 80 that has the specification values described above, an elastic intermediary image transfer belt having the following features may be used. The elastic intermediary image transfer belt has a base layer that is made of conductive polyimide (thickness: 80 μm), an elastic layer that is made of urethane rubber (thickness: 200 μm) (hardness: JIS-A30°), and a coat layer that is made of fluorocarbon resin (PFA or the like), fluorocarbon rubber, or the like (thickness: 10 μm). These layers are laminated one over another in this order. The width of the elastic intermediary image transfer belt is 324 mm. The thickness of the elastic intermediary image transfer belt is 290 μm. The volume resistivity of the elastic intermediary image transfer belt as an electric resistance of all layers is $10^{10}$ Ωcm. The intermediary image transfer belt 80 is an example of a "developer retaining member" and a "transfer member" according to an aspect of the invention.

Each primary image transfer roller 51, which has an outer diameter of 30 mm, is a so-called bias roller. The primary image transfer roller 51 is in contact with the photosensitive drum 10 indirectly with the intermediary image transfer belt 80 being pinched therebetween. The primary image transfer roller 51 has a metal base portion and a substantially cylindrical surface layer portion. The surface layer portion is attached to the outer circumferential part of the base portion. The thickness of the surface layer portion is 5.0 mm. The material of the surface layer portion is urethane rubber. The hardness of the surface layer portion conforms to JIS-30°. The volume resistivity of the surface layer portion when a voltage of 250V is applied thereto is $10^4$ Ωcm. An urging means such as a spring or the like presses each primary image transfer roller 51 toward the rotating shaft of the corresponding photosensitive drum 10. Each primary image transfer roller 51 applies a predetermined load to the intermediary image transfer belt 80. For example, a primary image transfer load of 5 kgf is applied to the intermediary image transfer belt 80. When a bias is applied to the primary image transfer roller 51, a developed toner image of the color attached to the corresponding photosensitive drum 10 is transferred onto the image-carrying surface 80A of the intermediary image transfer belt 80. As a result of the application of the bias for image transfer to each primary image transfer roller 51, a full-color toner image is formed on the image-carrying surface 80A of the intermediary image transfer belt 80. Or, a single-color toner image is formed thereon. A "member that performs primary image transfer operation" is not limited to transfer rollers. For example, a member that includes an electrode plate that has a substantially arc shape may be used.

The diselectrification device 6 and the cleaning device 8 are provided at a relatively downstream side viewed from the primary image transfer roller 51 along the direction of rotation of the photosensitive drum 10. The diselectrification device 6 is provided at a downstream position closer to the primary image transfer position. The cleaning device 8 is used for removing, from the photosensitive drum 10, a developer that did not move onto the intermediary image transfer belt 80 during the process of primary image transfer and thus remains on the photosensitive drum 10.

Figure 3:
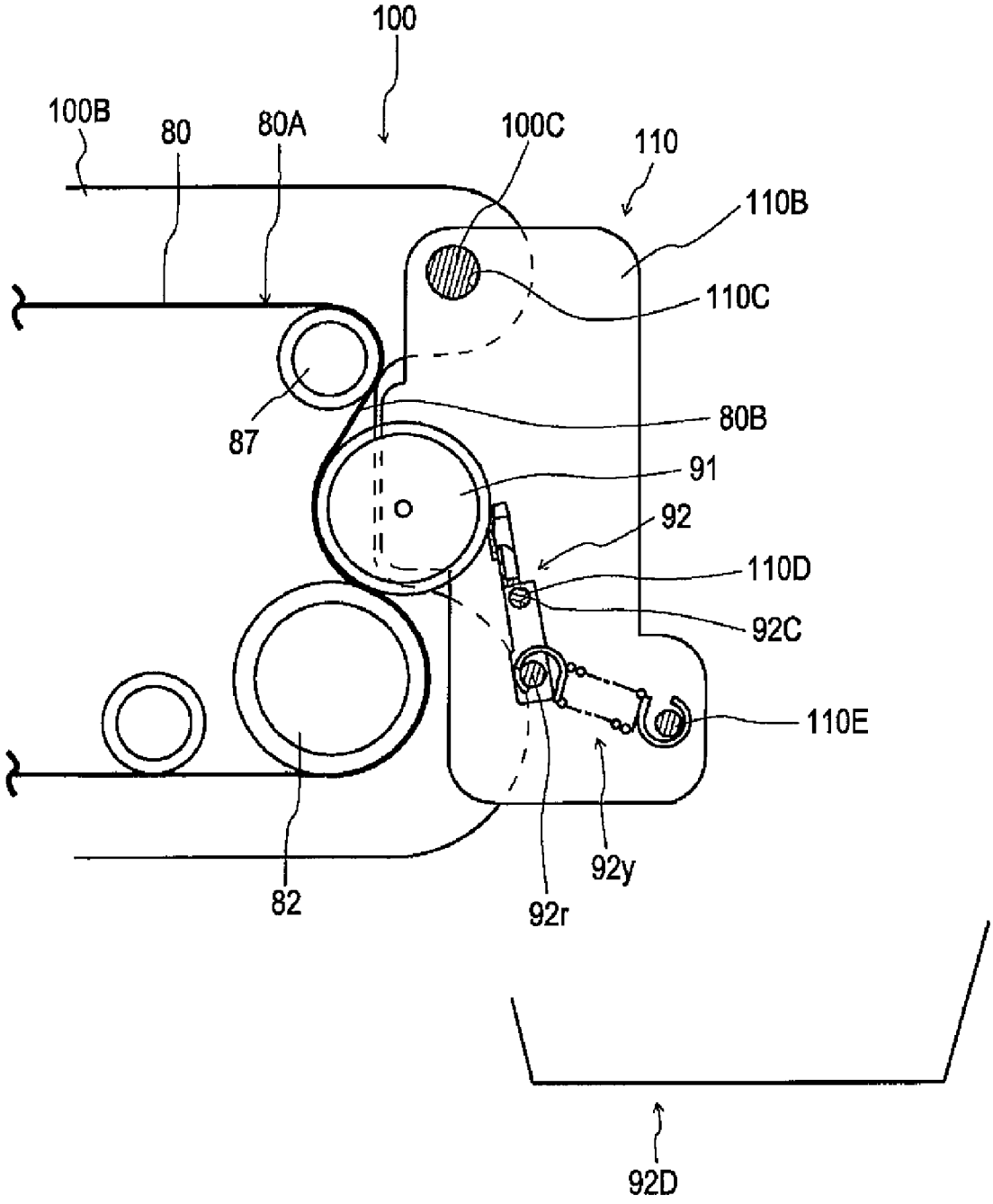
FIG. 3 is a diagram that schematically illustrates an example of the positional relation of a secondary image transfer frame, an image transfer frame, a secondary image transfer roller set in a contact position, and a cleaning device according to an exemplary embodiment of the invention.
Figure 4:
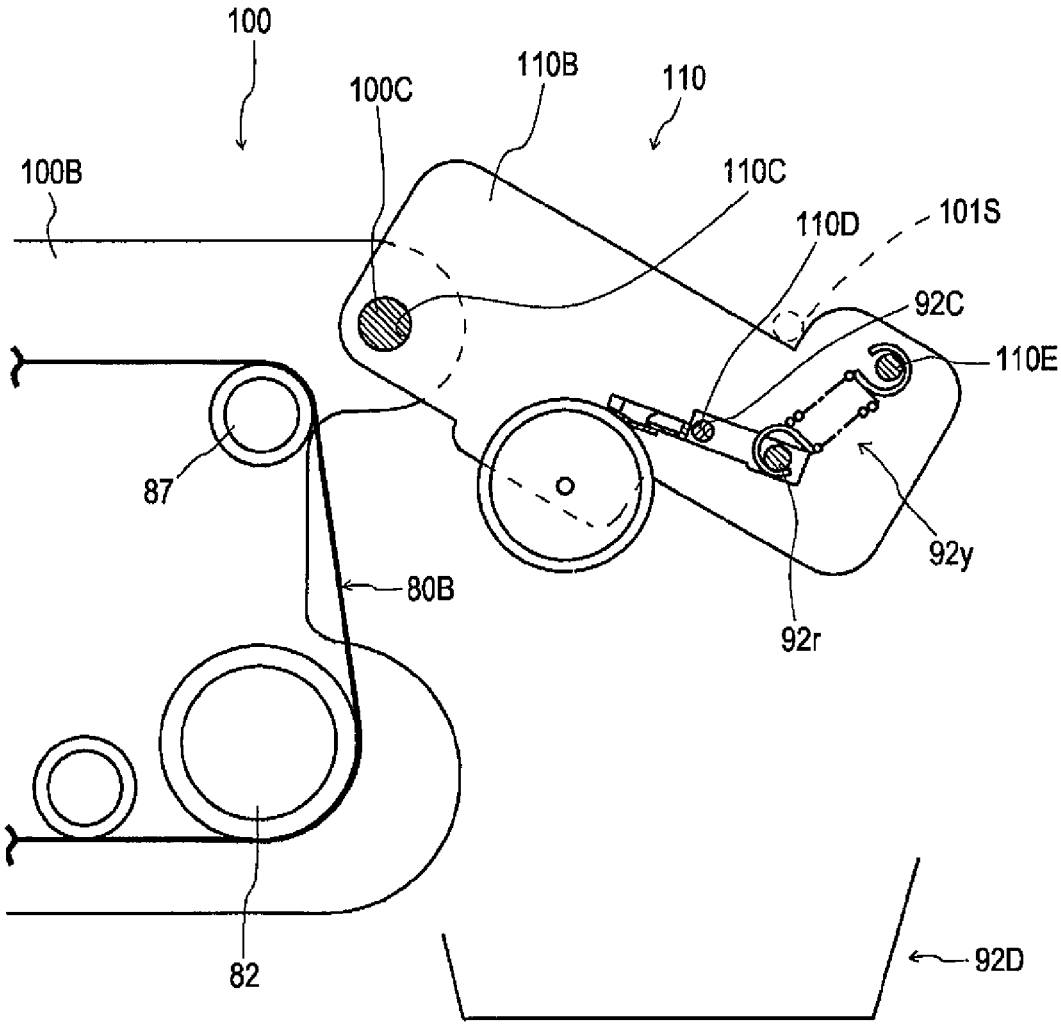
FIG. 4 is a diagram that schematically illustrates an example of the positional relation of the secondary image transfer frame, the image transfer frame, the secondary image transfer roller set in a non-contact position, and the cleaning device according to an exemplary embodiment of the invention.
Figure 5:
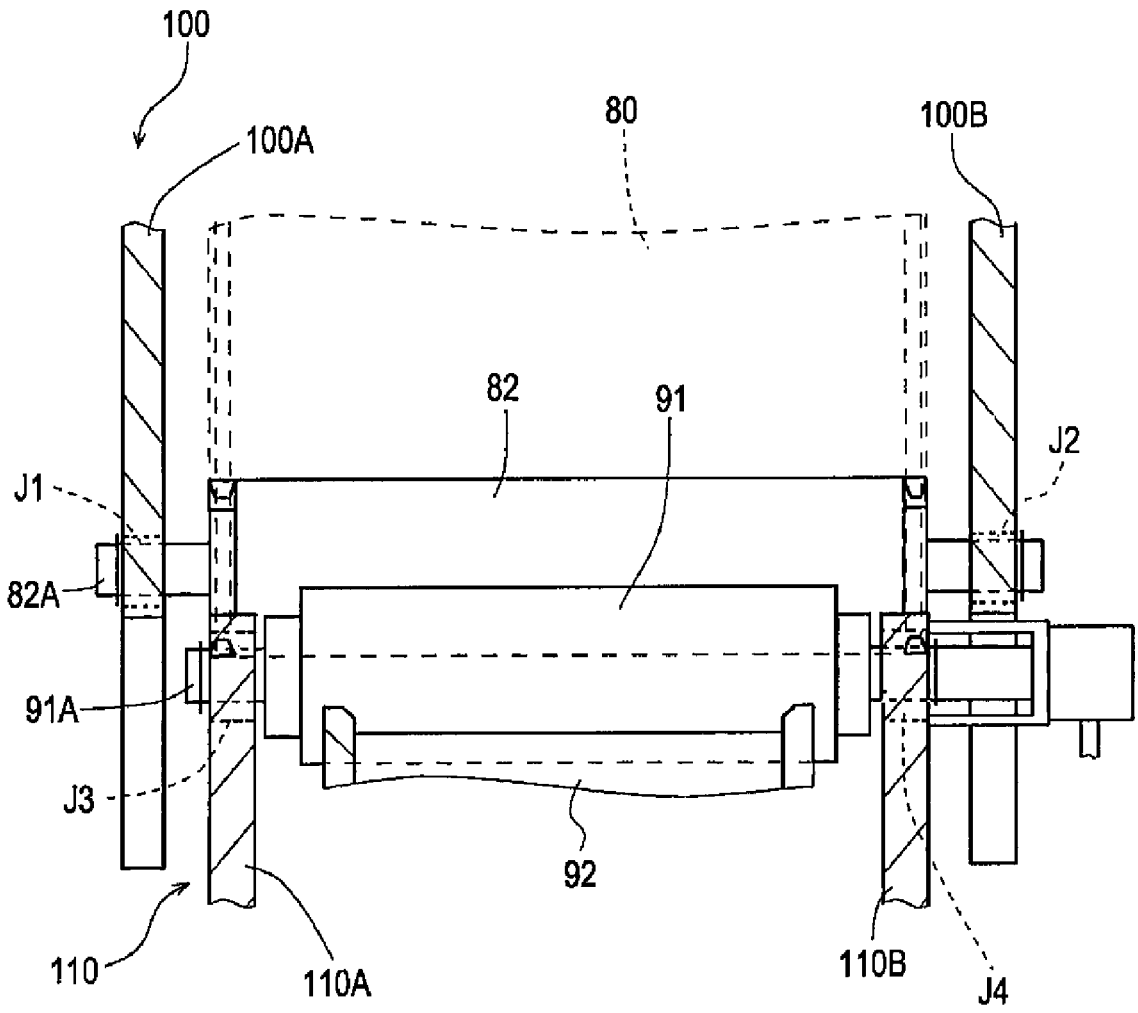
FIG. 5 is a partial transverse sectional view that schematically illustrates an example of the positional relation of the secondary image transfer frame, the image transfer frame, the secondary image transfer roller, and the cleaning device according to an exemplary embodiment of the invention.

The secondary image transfer unit 90 includes a secondary image transfer roller 91 and a cleaning device 92. The secondary image transfer roller 91 can be brought into contact with the image-carrying surface 80A of the intermediary image transfer belt 80. A catching basin 92D is provided directly below the cleaning device 92. The catching basin 92D catches a liquid developer dripping from the cleaning device 92. Supported by a secondary image transfer frame 110, the secondary image transfer roller 91 and the cleaning device 92 can move in a swinging direction. As illustrated in FIGS. 3, 4, and 5, the image formation apparatus A is provided with an image transfer frame 100 in addition to the secondary image transfer frame 110. The secondary image transfer frame 110 is provided inside the image transfer frame 100. The image transfer frame 100 supports the secondary image transfer frame 110. The secondary image transfer frame 110 can move in a swinging direction. The image transfer frame 100 includes a pair of side plates 100A and 100B. The side plates 100A and 100B stand in substantially parallel to each other with a distance therebetween. The secondary image transfer frame 110 also includes a pair of side plates 110A and 110B, which stand inside the image transfer frame 100 in substantially parallel to each other with a distance therebetween. The secondary image transfer roller 91 is an example of a "roller member" and a "transfer roller" according to an aspect of the invention. The secondary image transfer frame 110 is an example of a "supporting unit" according to an aspect of the invention.

Bearing members J1 and J2 are respectively embedded at positions close to the lower ends of the side plates 100A and 100B, which make up the image transfer frame 100. The bearing members J1 and J2 support the respective ends of a rotating shaft 82A of the aforementioned second roller 82 rotatably. Another pair of bearing members, which is not illustrated in the drawing, is embedded near the upper ends of the side plates 100A and 100B. These bearing members support the respective ends of a rotating shaft of the aforementioned auxiliary roller 87 rotatably. In addition, each end of a swing center shaft 100C is supported above, which is not just above, the auxiliary roller 87 on the corresponding side plate 100A, 100B. The ends of the swing center shaft 100C are supported in a rotatable manner. Each of the side plates 110A and 110B, which make up the secondary image transfer frame 110, has a through hole 110C. The through hole 110C is formed at a position very close to the upper end of the side plate 110A, 110B. As illustrated in FIGS. 3 and 4, the swing center shaft 100C is inserted through these through holes 110C. With such a structure, the secondary image transfer frame 110 is supported on the image transfer frame 100 via the swing center shaft 100C. In addition, the secondary image transfer frame 110 can move in a swinging direction with respect to the center of, that is, around, the swing center shaft 100C.

Figure 6:
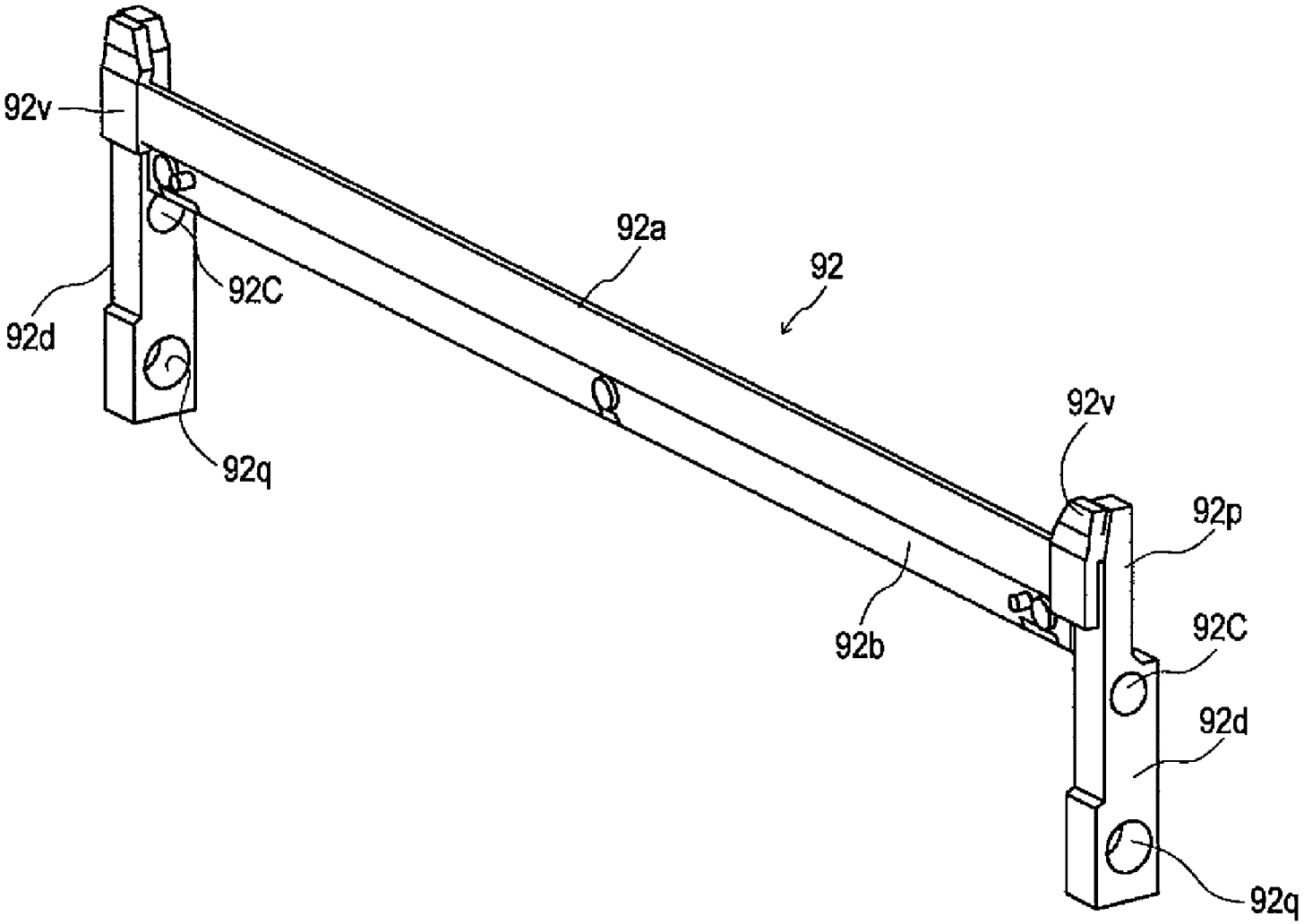
FIG. 6 is a perspective view that schematically illustrates an example of the configuration of the cleaning device according to an exemplary embodiment of the invention.

Bearing members J3 and J4 are embedded at roughly halfway positions between the upper and lower ends of the side plates 110A and 110B, respectively. The bearing members J3 and J4 support the respective ends of a rotating shaft 91A of the secondary image transfer roller 91 rotatably. In addition, respective ends of another swing center shaft 110D are supported somewhere between the upper and lower ends of the side plates 110A and 110B and closer to the lower ends thereof near the embedded positions of the bearing members J3 and J4. The ends of the swing center shaft 110D are supported in a rotatable manner. As illustrated in FIG. 6, the cleaning device 92 has a pair of through holes 92C. The swing center shaft 110D is inserted through the through holes 92C. Therefore, the secondary image transfer frame 110 supports the cleaning device 92 in such a manner that the cleaning device 92 can move in a swinging direction. With such a structure, as explained earlier, the secondary image transfer roller 91 and the cleaning device 92 can swing around the swing center shaft 100C while being supported by the secondary image transfer frame 110.

As illustrated in FIG. 3, when the secondary image transfer frame 110 is turned in one swing direction (which is a clockwise direction in the drawing) around the swing center shaft 100C, the secondary image transfer roller 91 is brought into contact with the second roller 82 indirectly with the intermediary image transfer belt 80 being pinched therebetween. When the secondary image transfer roller 91 is indirectly in contact with the second roller 82, a constant load is applied thereto. Since the second roller 82 serves as a stopper, the secondary image transfer frame 110 does not turn further in the one swing direction with an increasing rotation momentum. This position of the secondary image transfer roller 91 may be hereinafter referred to as an "image transfer position". When the secondary image transfer roller 91 reaches the image transfer position, the secondary image transfer roller 91 applies pressure to a region B of the intermediary image transfer belt 80 that is currently located between the second roller 82 and the auxiliary roller 87. Accordingly, the region B of the intermediary image transfer belt 80 becomes curved along the secondary image transfer roller 91 in a slightly wound manner.

When the secondary image transfer frame 110, which currently sets the secondary image transfer roller 91 at the image transfer position, is turned in the other swing direction (which is a counterclockwise direction in the drawing) around the swing center shaft 100C, the secondary image transfer frame 110 is brought into contact with a second stopper 101S that is provided on the image formation apparatus A as illustrated in FIG. 4. Because of the presence of the second stopper 101S, the secondary image transfer frame 110 does not turn in the other swing direction beyond the second stopper 101S. When the secondary image transfer frame 110 is in contact with the second stopper 101S, the secondary image transfer roller 91 is most distant from the region B of the intermediary image transfer belt 80 that is currently located between the second roller 82 and the auxiliary roller 87. This position of the secondary image transfer roller 91 may be hereinafter referred to as an "upper limit position".

In the structure of the image formation apparatus A according to the present embodiment of the invention, the secondary image transfer roller 91 and the cleaning device 92 are built on the secondary image transfer frame 110. As the secondary image transfer frame 110 moves, the secondary image transfer roller 91 and the cleaning device 92 also move together with the secondary image transfer frame 110. Accordingly, it is not necessary to control the movement of the secondary image transfer roller 91 and the movement of the cleaning device 92 separately. All that is required is to set the fulcrum of the swinging operation of the secondary image transfer frame 110. Therefore, the image formation apparatus A has an advantage of a simple structure.

The secondary image transfer roller 91 is used for transferring an image carried on the image-carrying surface 80A of the intermediary image transfer belt 80 onto a recording target medium 88 such as a sheet of printing paper, film, cloth, or the like (refer to FIG. 1). Specifically, after the setting of the secondary image transfer roller 91 at the image transfer position, an image carried on the image-carrying surface 80A of the intermediary image transfer belt 80 is transferred onto the recording target medium 88 that is transported on a recording target medium transportation path L at a contact region between the secondary image transfer roller 91 and the image-carrying surface 80A of the intermediary image transfer belt 80. When secondary image transfer operation is performed consecutively on a plurality of sheets of printing paper or the like, the secondary image transfer roller 91 is almost continuously on the intermediary image transfer belt 80 indirectly with the recording target medium being pinched therebetween. However, in such consecutive secondary image transfer operation, since it is practically difficult to array plural sheets of printing paper or the like transported one after another without any clearance therebetween, the secondary image transfer roller 91 contacts directly with the intermediary image transfer belt 80 at each gap between two sheets under transportation. As a result, a liquid developer (i.e., an image) that is retained on the image-carrying surface 80A transfers onto the secondary image transfer roller 91. An image fixation unit, which is not illustrated in the drawing, applies heat and pressure to an image that has been transferred onto a recording target medium to fix the image thereon.

When secondary image transfer operation is not performed, the secondary image transfer frame 110 is turned to set the secondary image transfer roller 91 at the upper limit position. As a result, the secondary image transfer roller 91 is distanced from the intermediary image transfer belt 80. In the structure of the image formation apparatus A according to the present embodiment of the invention, as explained above, when the secondary image transfer roller 91 is set at the image transfer position, the region B of the intermediary image transfer belt 80 is curved along the secondary image transfer roller 91 in a slightly wound manner. Notwithstanding the foregoing, the region B of the intermediary image transfer belt 80 may not be in contact with the secondary image transfer roller 91 when the roller 91 is set at the image transfer position. In such a modified structure, it is possible to cause the second roller 82 to function also as a backup roller during secondary image transfer operation.

Figure 7:
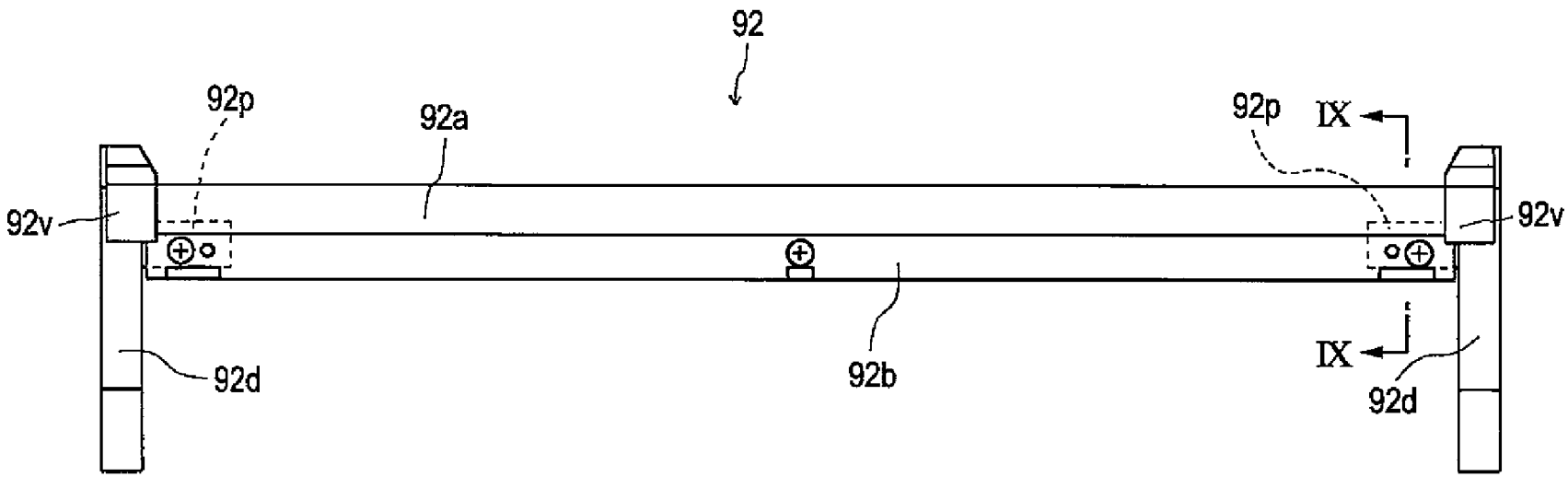
FIG. 7 is a front view that schematically illustrates an example of the configuration of the cleaning device according to an exemplary embodiment of the invention.

As illustrated in FIGS. 6 and 7, the cleaning device 92 is provided with a cleaning blade 92*a*, a cleaning-blade supporting steel plate 92*b*, a pair of cleaning frames 92*d*, 92*d*, a pair of sealing members 92*v*, 92*v*, and an urging means 92*y* (refer to FIGS. 3 and 4).

The cleaning blade 92*a* is an elongated plate member that is made of urethane rubber. For example, the urethane rubber is produced as a result of combining polyester polyol such as polyethylene adipate, f-caprolactone ester polyol, and butylene adipate with polyisocyanate in a chemical reaction. The cleaning blade 92*a* may be made of other material such as fluorocarbon rubber, silicon rubber, chloroprene rubber, butadiene rubber, or the like. Among various kinds of rubber, urethane rubber (polyurethane rubber) offers excellent wear and abrasion resistance. For this reason, it is preferable to use urethane rubber as the material of the cleaning blade 92*a*.

Figure 8:
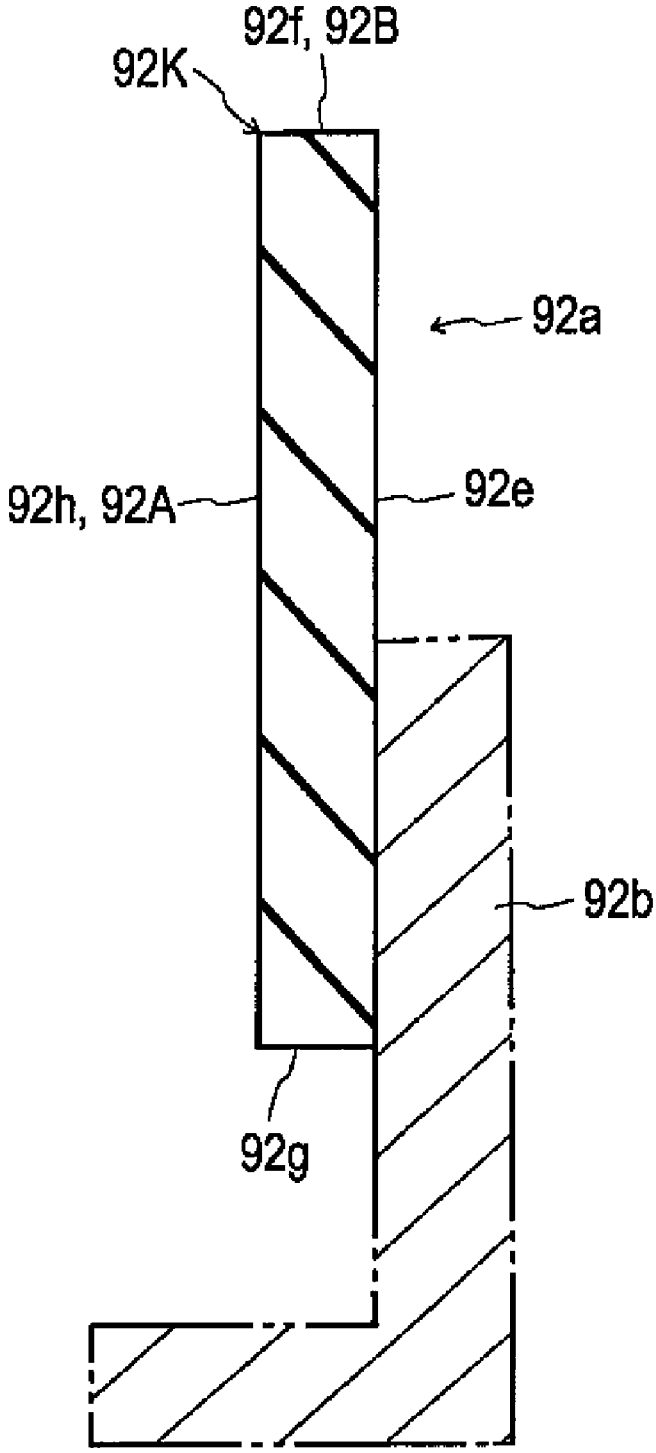
FIG. 8 is a longitudinal sectional view that schematically illustrates an example of the configuration of a cleaning blade according to an exemplary embodiment of the invention.

For example, the cleaning blade 92*a* can be manufactured as follows. A urethane formation material (polyurethane composition that contains polyisocyanate and polyol) is injected into a molding die. An elongated base material, which is urethane rubber, is formed by a so-called centrifugal molding method. Then, the base material is cut into the cleaning blade 92*a* that has a predetermined width with the use of a cutter or the like. As illustrated in FIG. 8, the cleaning blade 92*a* has an end face 92*e* that was in contact with the inner wall surface of a molding die during the molding of the urethane rubber base material. This surface may be hereinafter referred to as a "die contact surface". The cleaning blade 92*a* further has end faces 92*f* and 92*g* that are produced as a result of cutting the base material. These surfaces may be hereinafter referred to as "cut surfaces". The die contact surface 92*e* is a plane that is parallel to the cleaning-blade supporting steel plate 92*b*, which will be explained later. Each of the cut surfaces 92*f* and 92*g* is a plane that intersects with the die contact surface 92*e*.

The cleaning blade 92*a* has the following surface roughness. The centerline average roughness Ra of the die contact surface 92*e* is 0.01 μm. The ten-point average roughness (i.e., ten-point medium height) Rz of the die contact surface 92*e* is 0.07 μm. The centerline average roughness Ra of the cut surfaces 92*f* and 92*g* is 0.32 μm. The ten-point average roughness Rz of the cut surfaces 92*f* and 92*g* is 1.85 μm. Therefore, the liquid-retaining capability of the cut surfaces 92*f* and 92*g* is greater than that of the die contact surface 92*e*. After the dropping of pure water "0.5 uL" on each of the die contact surface 92*e* and the cut surface 92*f*, 92*g*, an angle of contact for each was measured with the use of measurement equipment (trade name: DROPMASTER) (Manufactured by Kyowa Interface Science Co., Ltd.). A θ/2 method was used. The angle of contact for the die contact surface 92*e* was 110°. The angle of contact for the cut surface 92*f*, 92*g* was 80°. Accordingly, the cut surface 92*f*, 92*g* of the cleaning blade 92*a* is oleophilic whereas the die contact surface 92*e* thereof is oleophobic. Therefore, with the structure of the cleaning blade 92*a*, it is easy to retain a liquid developer on the cut surface 92*f*, 92*g*. In addition, a liquid developer is repelled at the die contact surface 92*e* and thus flows easily.

As illustrated in FIG. 8, the cleaning blade 92*a* has the die contact surface 92*e* at one side and another surface 92*h* at the other side. The surface 92*h* may be hereinafter referred to as an "opposite surface". The opposite surface 92*h* is an example of a "first plane 92A". One of the two cut surfaces 92*f* and 92*g* illustrated as the upper surface in FIG. 8, that is, the cut surface 92*f*, is an example of a "second plane 92B". The first plane 92A and the second plane 92B intersect to form a corner edge, which is a part where these planes meet with each other. The corner edge functions as a contact edge 92K. In the structure of the cleaning blade 92*a* according to the present embodiment of the invention, the first plane 92A and the second plane 92B are substantially orthogonal to each other.

Figure 9:
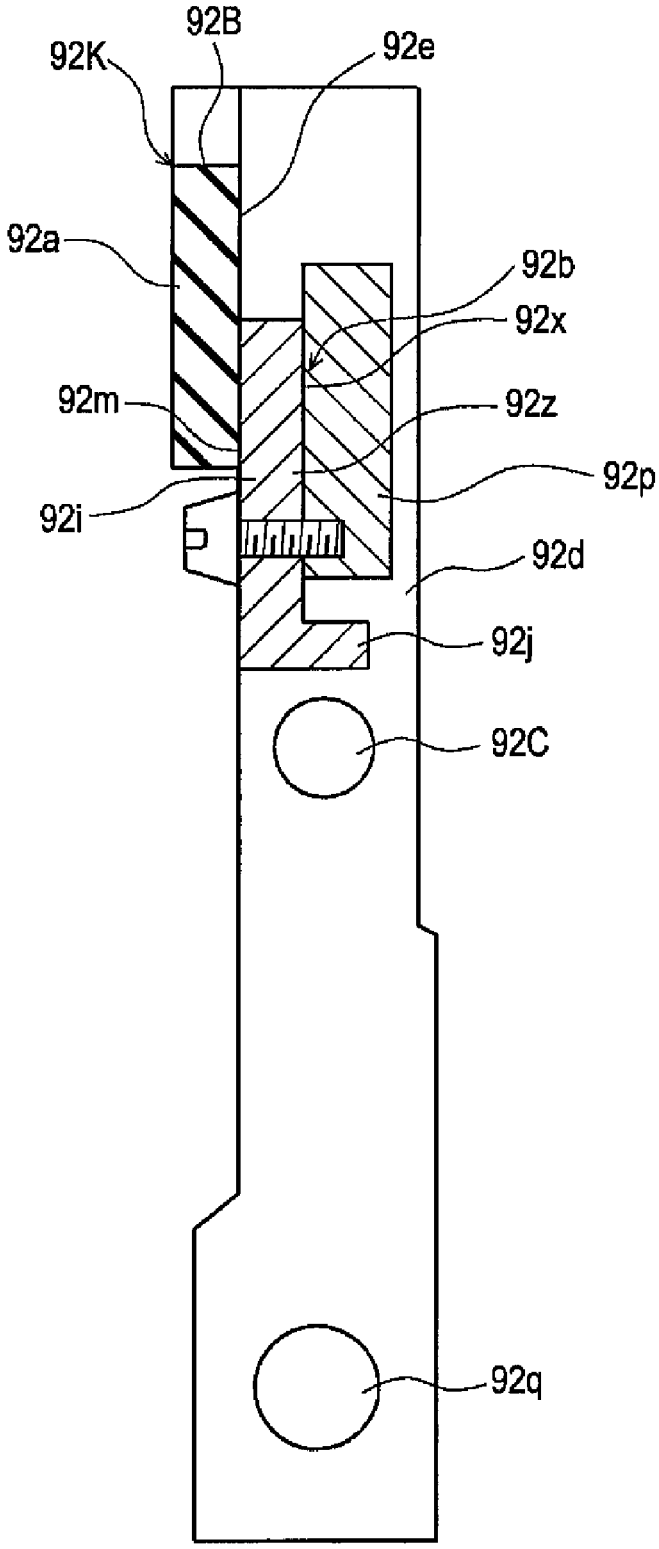
FIG. 9 is a sectional view taken along the line IX-IX of FIG. 7.

The cleaning-blade supporting steel plate 92*b* is an example of a "supporting member" according to an aspect of the invention. As illustrated in FIG. 9, the cleaning-blade supporting steel plate 92*b* is an L-shaped steel plate in longitudinal section. The cleaning-blade supporting steel plate 92*b* has a supporting body portion 92*i* and a bend protrusion portion 92*j*. The supporting body portion 92*i* is an elongated steel plate. The bend protrusion portion 92*j* protrudes from one end of the supporting body portion 92*i* (the lower end in FIG. 9) to form a bent structure. A surface of the supporting body portion 92*i* that faces in a direction opposite to the protruding direction of the bend protrusion portion 92*j* is a cleaning-blade supporting surface 92*m* on which the cleaning blade 92*a* is supported. A surface that is opposite to the cleaning-blade supporting surface 92*m* in the structure of the cleaning-blade supporting steel plate 92*b* may be hereinafter referred to as a held surface 92*x*.

The cleaning-blade supporting surface 92*m* is disposed opposite to the die contact surface 92*e* with the second plane 92B being disposed above the die contact surface 92*e*. The long sides thereof are oriented horizontally when they are disposed opposite to each other. The upper part of the cleaning-blade supporting surface 92*m* is bonded to the lower part of the die contact surface 92*e*. In this way, the cleaning blade 92*a* and the cleaning-blade supporting steel plate 92*b* are combined into a single component. When this component is viewed from a certain point in front of the cleaning blade 92*a*, the cleaning-blade supporting steel plate 92*b* is provided at the rear of the cleaning blade 92*a* having the contact edge 92K and the second plane B as a top edge and the top surface, respectively.

As illustrated in FIG. 6, the cleaning frames 92*d*, 92*d* support the respective ends of the elongated component made up of the cleaning blade 92*a* and the cleaning-blade supporting steel plate 92*b*. That is, the cleaning frames 92*d*, 92*d* function as a pair of swing arms that support the respective ends of the elongated component made up of the cleaning blade 92*a* and the cleaning-blade supporting steel plate 92*b*. Supported by these swing arms, the cleaning blade 92*a* is brought into contact with, and moves away from, the secondary image transfer roller 91.

As illustrated in FIGS. 6 and 9, a region near one end of each of the cleaning frames 92*d*, 92*d* viewed along the long side thereof, specifically, a part near the front end of the arm, has a function of holding the cleaning-blade supporting steel plate 92*b*. As illustrated in FIGS. 7 and 9, a holding member 92*p* of one cleaning frame 92*d* is attached to one end of the held surface 92*x* of the elongated cleaning-blade supporting steel plate 92*b*. A holding member 92*p* of the other cleaning frame 92*d* is attached to the other end of the held surface 92*x* of the elongated cleaning-blade supporting steel plate 92*b*. The cleaning-blade supporting steel plate 92*b* is fixed to the one cleaning frame 92*d* at the one end thereof viewed in the long-side direction with the use of a screw. The cleaning-blade supporting steel plate 92*b* is fixed to the other cleaning frame 92*d* at the other end thereof viewed in the long-side direction with the use of another screw.

The aforementioned through hole 92C is formed roughly at the center of each of the cleaning frames 92*d*, 92*d* viewed along the long side thereof. The through holes 92C, 92C of the respective cleaning frames 92*d*, 92*d* are concentrically aligned with each other in the long-side direction of the cleaning-blade supporting steel plate 92*b*. The aforementioned swing center shaft 110D is inserted through the through holes 92C, 92C. Therefore, the secondary image transfer frame 110 supports the cleaning device 92 in such a manner that the cleaning device 92 can move in a swinging direction thereon.

As illustrated in FIGS. 6 and 9, a through hole 92*q* is formed at the other end of each of the cleaning frames 92*d*, 92*d* viewed along the long side thereof. The through holes 92*q*, 92*q* of the respective cleaning frames 92*d*, 92*d* are concentrically aligned with each other in the long-side direction of the cleaning-blade supporting steel plate 92*b*. The cleaning frames 92*d*, 92*d* support the respective ends of a supporting shaft 92*r* at the through holes 92*q*, 92*q* in such a manner that the supporting shaft 92*r* cannot rotate (refer to FIGS. 3 and 4).

The sealing members 92*v*, 92*v* are attached to the respective ends of the elongated cleaning blade 92*a*. The sealing members 92*v*, 92*v* perform sealing operation at the respective ends of the cleaning blade 92*a* viewed in the long-side direction.

The urging means 92*y* is a coil spring. The urging means 92*y* hooks on the supporting shaft 92*r* at one end. The urging means 92*y* hooks on another supporting shaft 110E at the other end. The supporting shaft 110E is fixed between the side plates 110A and 110B, which make up the secondary image transfer frame 110 (refer to FIGS. 3 and 4). The urging means 92*y* applies an urging force that acts in a direction of shortening the distance between the supporting shaft 92*r* and the supporting shaft 110E. Because of such an urging force, a turning force acts in a direction of urging the one end of each of the cleaning frames 92*d*, 92*d* viewed along the long side thereof toward the secondary image transfer roller 91. Therefore, in the operation of the image formation apparatus A, the contact edge 92K of the cleaning blade 92*a* stays in contact with the outer circumferential surface of the secondary image transfer roller 91 under the urging force applied by the urging means 92*y*.

Figure 10:
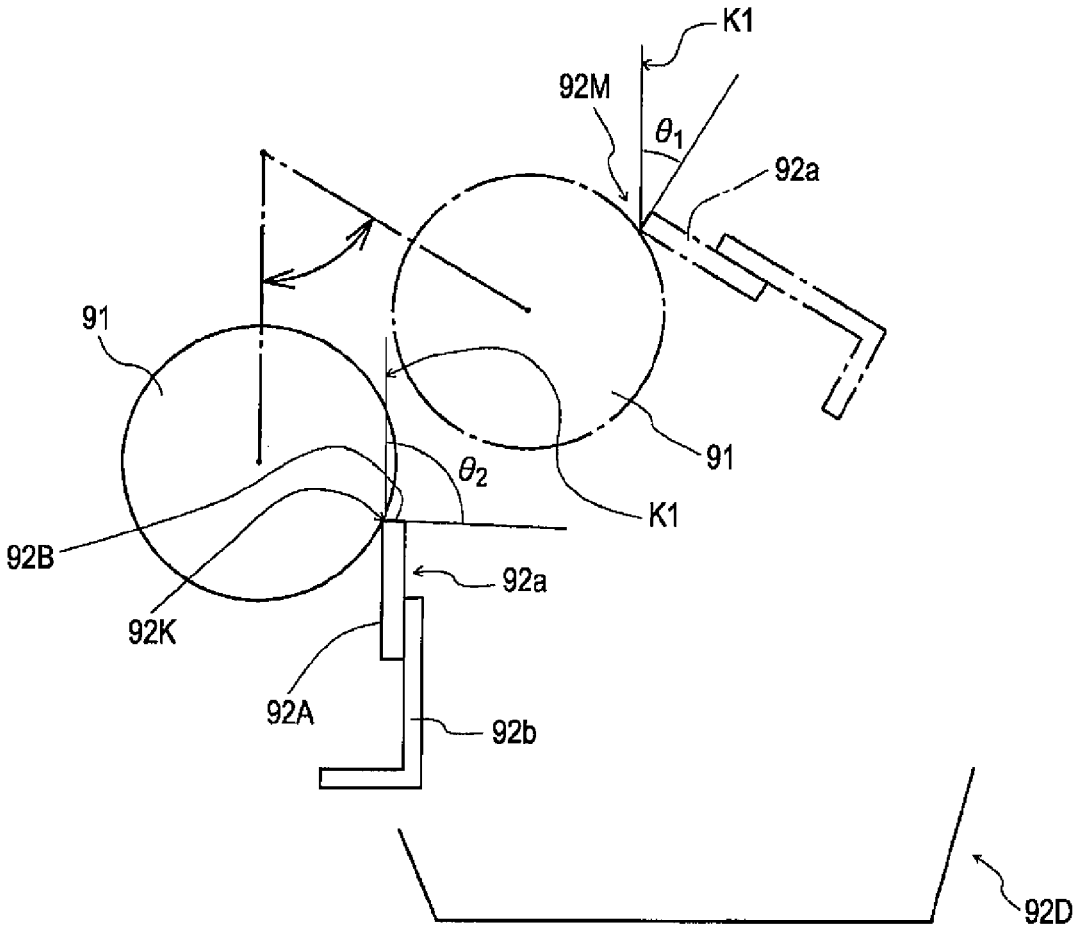
FIG. 10 is a diagram that schematically illustrates an example of the positional switching of the secondary image transfer roller between the contact position and the non-contact position in the operation of an image formation apparatus according to a first embodiment of the invention.

As illustrated in FIG. 10, an angle $\theta_2$ that is formed by a virtual vertical plane K1 and the second plane 92B thereunder is greater than 90° when the secondary image transfer roller 91 of the image formation apparatus A is set at the image transfer position. For example, the angle $\theta_2$ is 93°. Since the angle $\theta_2$ is greater than 90°, there is a greater possibility that a liquid developer wiped off the secondary image transfer roller 91 with the cleaning device 92 flows over the second plane 92B, which forms a declining slope, and then drops from the sloped surface. The catching basin 92D is provided under the cleaning device 92. The catching basin 92D catches the liquid developer that drips from the cleaning device 92 for recovery.

On the other hand, an angle $\theta_1$ that is formed by the virtual vertical plane K1 and the second plane 92B thereunder is not greater than 90° when the secondary image transfer roller 91 is set at the upper limit position. For example, the angle $\theta_1$ is 30°. Since the angle $\theta_1$ is not greater than 90°, the outer circumferential surface of the secondary image transfer roller 91 and the second plane 92B form a reservoir (i.e., gutter) 92M that has a substantially wedged shape in longitudinal section. Therefore, a liquid developer that remains on the outer circumferential surface of the secondary image transfer roller 91 is likely to be trapped in the wedged reservoir 92M. Even when the secondary image transfer roller 91 is continuously set at the upper limit position for a while, a liquid developer is likely to be trapped in the reservoir (gutter) 92M. Therefore, it is possible to prevent any inner component of the image formation apparatus A from being stained by the liquid developer or to reduce such a risk of staining the inner components of the image formation apparatus A.

In addition, even when the set position of the secondary image transfer roller 91 is switched over to the image transfer position after continuous setting of the roller 91 at the upper limit position for a while, a liquid developer is likely to be trapped in the reservoir 92M. For this reason, it is possible to reduce a risk of great friction between the cleaning blade 92*a* and the secondary image transfer roller 91. Thus, the squeaking of the cleaning blade 92*a* is less likely to occur. In addition, a driving torque of the secondary image transfer roller 91 does not increase.

B. Second Embodiment

Figure 11:
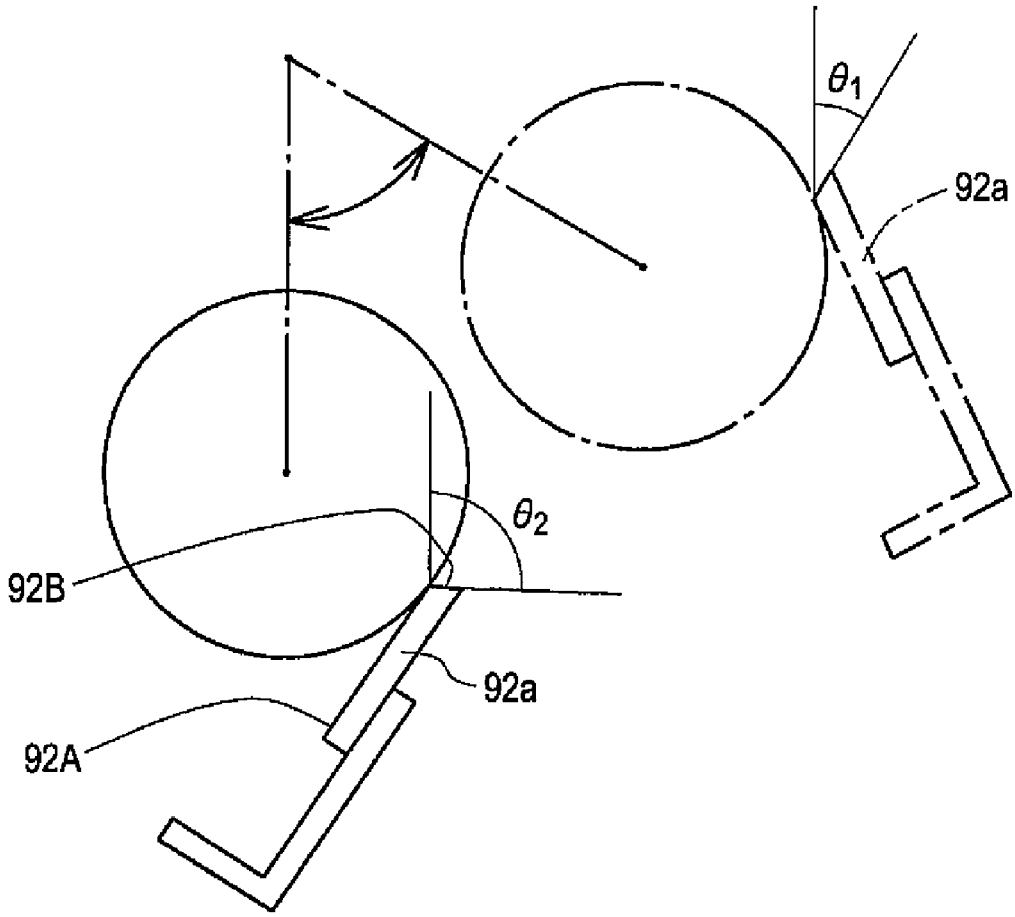
FIG. 11 is a diagram that schematically illustrates an example of the positional switching of the secondary image transfer roller between the contact position and the non-contact position in the operation of an image formation apparatus according to a second embodiment of the invention.

The structure of an image formation apparatus according to a second embodiment of the invention is the same as that of the image formation apparatus A according to the first embodiment of the invention explained above except for the following difference. As illustrated in FIG. 11, the structure of an image formation apparatus according to the second embodiment of the invention is different from that of the image formation apparatus A according to the first embodiment of the invention in that an angle that is formed by the first plane 92A of the cleaning blade 92*a* and the second plane 923 thereof is an obtuse angle. In other words, the second plane 92B is formed as an inclined surface that slopes down toward another surface of the cleaning blade 92*a* that faces toward the secondary image transfer roller 91. This means that the second plane 92B is inclined downward toward the first plane A.

With the structure of an image formation apparatus according to the second embodiment of the invention, when the secondary image transfer roller 91 is distanced from the intermediary image transfer belt 80 to be set at the upper limit position defined in the first embodiment of the invention, it is possible to easily set the angle $\theta_1$ that is formed by the virtual vertical plane K1 and the second plane 92B at a smaller value, which is not greater than 90°. Moreover, even in a case where it is necessary to set the position of contact of the cleaning blade 92*a* and the secondary image transfer roller 91 below the contact position according to the first embodiment of the invention, or even in a case where more severe contact angle restrictions are imposed on the inclination of the cleaning blade 92*a*, it is easier to satisfy the mathematical condition of "$0° < \theta_1 \leqq 90°$", the mathematical condition of "$\theta_2 > \theta_1$", and the mathematical condition of "$\theta_2 > 90°$".

C. Third Embodiment

Figure 12:
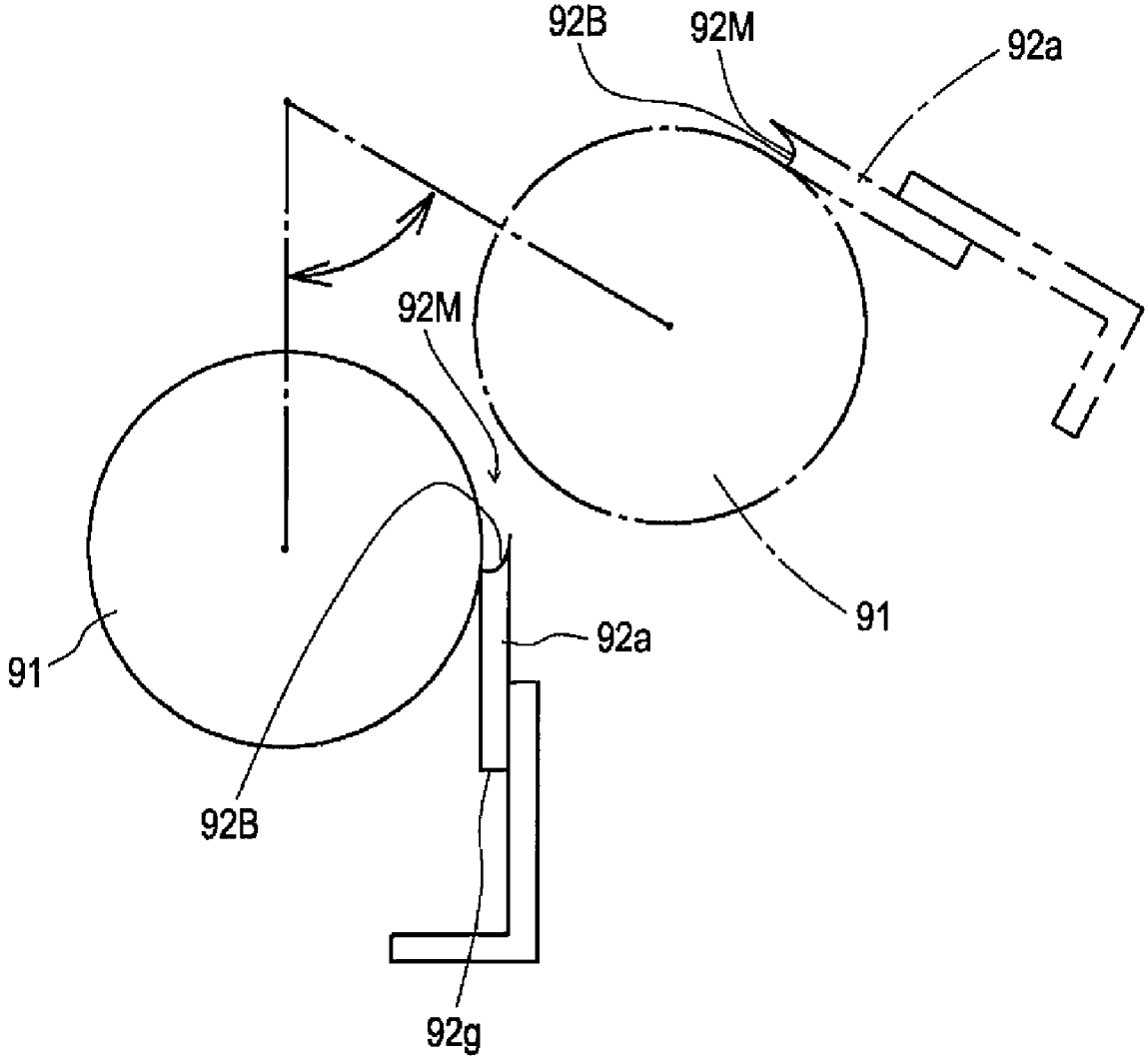
FIG. 12 is a diagram that schematically illustrates an example of the positional switching of the secondary image transfer roller between the contact position and the non-contact position in the operation of an image formation apparatus according to a third embodiment of the invention.

The structure of an image formation apparatus according to a third embodiment of the invention is the same as that of the image formation apparatus A according to the first embodiment of the invention explained earlier except for the following difference. As illustrated in FIG. 12, the structure of an image formation apparatus according to the third embodiment of the invention is different from that of the image formation apparatus A according to the first embodiment of the invention in that the second plane 92B of the cleaning blade 92*a* is formed as a rounded concave surface that caves toward the opposite cut surface 92*g*.

With the structure of an image formation apparatus according to the third embodiment of the invention, the rounded concave second plane 92B and the outer circumferential surface of the secondary image transfer roller 91 form the reservoir 92M, which is a gutter that has a shape resembling the letter U in a sectional view. Therefore, when the secondary image transfer roller 91 is distanced from the intermediary image transfer belt 80 to be set at the upper limit position defined in the first embodiment of the invention, it is possible to securely trap a liquid developer in the reservoir 92M.

D. Fourth Embodiment

Figure 13A:
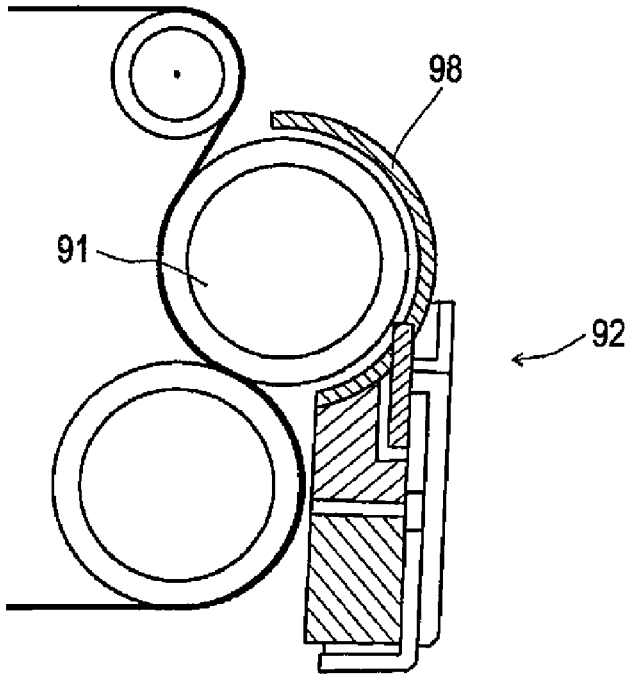
FIGS. 13A and 13B are a set of longitudinal sectional views that schematically illustrates an example of the configuration of the secondary image transfer roller and the cleaning device of an image formation apparatus according to a fourth embodiment of the invention.
Figure 13B:
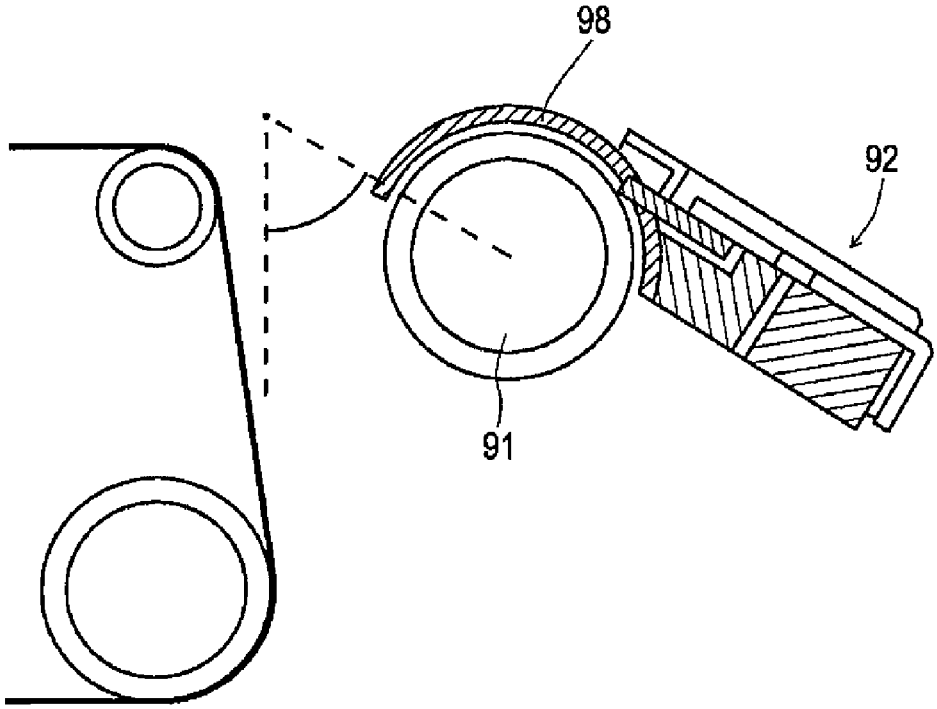

The structure of an image formation apparatus according to a fourth embodiment of the invention is the same as that of the image formation apparatus A according to the first embodiment of the invention explained earlier except for the following difference. As illustrated in FIGS. 13A and 13B, the structure of an image formation apparatus according to the fourth embodiment of the invention is different from that of the image formation apparatus A according to the first embodiment of the invention in that a semi-circular arch cover 98 that encloses the secondary image transfer roller 91 is attached to the cleaning device 92.

With the structure of an image formation apparatus according to the fourth embodiment of the invention, it is possible to prevent any scattering of droplets of a liquid developer from the outer circumferential surface of the secondary image transfer roller 91 with the cover 98. If the cover 98 were not attached to the cleaning device 92, a part of the outer circumferential surface of the secondary image transfer roller 91 would be exposed when the secondary image transfer roller 91 is indirectly in contact with the second roller 82 with the intermediary image transfer belt 80 being pinched therebetween, that is, when the secondary image transfer roller 91 is rotating. In contrast, in the structure of an image formation apparatus according to the present embodiment of the invention, most of the part that would be otherwise exposed is enclosed by the cover 98 as illustrated in FIG. 13A. With such a cover, it is possible to effectively prevent a liquid developer from being scattered.

In the foregoing exemplary embodiments of the invention, the invention is applied to the cleaning device 92 that is provided for cleaning the secondary image transfer roller 91. However, the scope of the invention is not limited to such an example. The invention may be applied to various other cleaning devices provided for cleaning various other roller members, which are components of an image formation apparatus. For example, the invention may be applied to a cleaning device that is provided for cleaning the photosensitive drum squeeze roller 71, the cleaning device 8, and the like.

The concept of the invention can be industrially applied to, for example, the sale, operation, and manufacturing of a printer, a copier, and a facsimile without any limitation thereto.

With the features of the invention, it is possible to provide a technique for making it easier for a liquid developer to be securely trapped in a reservoir that is formed between a roller member (transfer roller), which is an cleaning target object that is to be cleaned, and a cleaning blade when the roller member is distanced from a roller-processing target member.

The entire disclosure of Japanese Patent Application No: 2008-264873, filed Oct. 14, 2008 is expressly incorporated by reference herein.

What is claimed is:

1. An image formation apparatus comprising:

a developer retaining member that retains a liquid developer that contains toner particle and carrier liquid;

a roller member that is brought into contact with the developer retaining member at a position and distanced from the developer retaining member at another position;

a cleaning blade that has a contact edge that is in contact with the roller member and that cleans the roller member; and a supporting member that supports the cleaning blade, wherein the cleaning blade has a first plane that is supported by the supporting member or is opposite to a surface that is supported by the supporting member and further has a second plane, the first plane and the second plane forming the contact edge, an angle $\theta_1$ that is formed by a virtual vertical plane and the second plane thereunder when the roller member is distanced from the developer retaining member is greater than zero degrees but not greater than ninety degrees ($0° < \theta_1 \leqq 90°$), and an angle $\theta_2$ that is formed by a virtual vertical plane and the second plane thereunder when the roller member is in contact with the developer retaining member is greater than the angle $\theta_1$ ($\theta_2 > \theta_1$).

2. The image formation apparatus according to claim 1, wherein the angle $\theta_2$ is greater than ninety degrees ($\theta_2 > 90°$).

3. The image formation apparatus according to claim 1, wherein the cleaning blade is made of an oleophilic material.

4. An image formation apparatus comprising:

a latent image carrier on which a latent image is formed;

a developing section that develops the latent image with the use of a liquid developer that contains toner particle and carrier liquid;

a transfer member onto which the image developed by the developing section on the latent image carrier is transferred;

a transfer roller that is brought into contact with the transfer member at a position and distanced from the transfer member at another position;

a transfer roller cleaning blade that has a contact edge that is in contact with the transfer roller and that cleans the transfer roller; and a supporting member that supports the transfer roller cleaning blade, wherein the transfer roller cleaning blade has a first plane that is supported by the supporting member or is opposite to a surface that is supported by the supporting member and further has a second plane, the first plane and the second plane forming the contact edge, an angle $\theta_1$ that is formed by a virtual vertical plane and the second plane thereunder when the transfer roller is distanced from the transfer member is greater than zero degrees but not greater than ninety degrees ($0° < \theta_1 \leqq 90°$), and an angle $\theta_2$ that is formed by a virtual vertical plane and the second plane thereunder when the transfer roller is in contact with the transfer member is greater than the angle $\theta_1$ ($\theta_2 > \theta_1$).

5. The image formation apparatus according to claim 4, wherein a supporting unit supports the transfer roller and the transfer roller cleaning blade; and the transfer roller is brought into contact with the transfer member or distanced from the transfer member as a result of movement of the supporting unit on a swing fulcrum.

6. An image formation method comprising:

developing a latent image formed on a latent image carrier with the use of a liquid developer that contains toner particle and carrier liquid to form a developed image on the latent image carrier;

transferring the developed image onto a transfer member;

bringing a transfer roller into contact with the transfer member so that the image transferred to the transfer member further transfers onto a recording target medium; and cleaning the transfer roller set at a distance from the transfer member, a contact edge of a transfer roller cleaning blade being in contact with the transfer roller for cleaning the transfer roller, the contact edge being formed by a first plane and a second plane, the first plane being supported by a supporting member that supports the transfer roller cleaning blade or is opposite to a surface that is supported by the supporting member, wherein, during the cleaning, an angle $\theta_1$ that is formed by a virtual vertical plane and the second plane of the transfer roller cleaning blade with the transfer roller being distanced from the transfer member is greater than zero degrees but not greater than ninety degrees ($0° < \theta_1 \leqq 90°$), and an angle $\theta_2$ that is formed by a virtual vertical plane and the second plane of the transfer roller cleaning blade when the transfer roller is in contact with the transfer member is greater than the angle $\theta_1$ ($\theta_2 > \theta_1$).

* * * * *